US006711780B2

(12) United States Patent
Lee

(10) Patent No.: US 6,711,780 B2
(45) Date of Patent: Mar. 30, 2004

(54) HINGE FOR COLLAPSIBLE LADDERS

(75) Inventor: Chan Bok Lee, Chungjoo-si (KR)

(73) Assignee: Sinclair Worldwide, Inc., Seoul (KR)

( * ) Notice: Subject to any disclaimer, the term of this patent is extended or adjusted under 35 U.S.C. 154(b) by 0 days.

(21) Appl. No.: 10/198,004

(22) Filed: Jul. 18, 2002

(65) Prior Publication Data

US 2003/0037412 A1 Feb. 27, 2003

(30) Foreign Application Priority Data

Aug. 22, 2001 (KR) ..... 2001-0025470

(51) Int. Cl.[7] ..... E05D 11/10

(52) U.S. Cl. ..... 16/326; 16/328; 16/334

(58) Field of Search ..... 16/326, 324, 327, 16/328, 329, 334; 403/92, 93, 96, 324; 182/163–165, 23, 22

(56) References Cited

U.S. PATENT DOCUMENTS

| | | | | |
|---|---|---|---|---|
| 1,696,357 A | | 12/1928 | Johnson | |
| 3,811,151 A | | 5/1974 | Kuemmerlin | |
| 4,085,899 A | | 4/1978 | Boothe | |
| 4,210,224 A | | 7/1980 | Kümmerlin et al. | |
| 4,216,844 A | | 8/1980 | Klafs | |
| 4,403,373 A | | 9/1983 | Kummerlin | |
| 4,407,045 A | | 10/1983 | Boothe | |
| 4,566,150 A | | 1/1986 | Boothe | |
| 4,577,986 A | | 3/1986 | Wang | |
| 4,666,327 A | | 5/1987 | Su | |
| 4,666,328 A | * | 5/1987 | Ryu | 403/92 |
| 4,697,305 A | | 10/1987 | Boothe | |
| 4,770,559 A | | 9/1988 | Yoo | |
| 4,890,950 A | * | 1/1990 | Yoo | 403/96 |
| D309,502 S | | 7/1990 | Wing et al. | |
| 6,343,406 B1 | * | 2/2002 | Yeh | 16/328 |

FOREIGN PATENT DOCUMENTS

| | | |
|---|---|---|
| DE | 2321346 | * 10/1974 |
| DE | 3005692 A1 | * 8/1981 |
| DE | 3900176 A1 | * 7/1990 |
| EP | 0000499 A1 | * 7/1978 |
| FR | 2392268 | * 12/1978 |
| WO | WO 01/83929 A1 | * 11/2001 |

* cited by examiner

*Primary Examiner*—Chuck Y. Mah
(74) *Attorney, Agent, or Firm*—Richard M. Goldberg

(57) ABSTRACT

A hinge for collapsible ladders, includes an external frame including a center aperture and a pair of locking apertures; an inner frame rotatable with the external frame and including a center aperture and pairs of locking apertures; a rotary plate rotatably disposed between the frames and having locking apertures; a substantially flat rotary spring having one end mounted to the inner frame and an opposite end mounted to the rotary plate; a hub member rotatably connecting the frames about the center apertures, and including a locking end at one side; a locking part for extension into the locking apertures to fix an angle of the frames relative to each other; a press axle connected with the locking part, passing through the hub member, and including a bearing end; and a spring positioned between the hub member locking end and the press axle bearing end.

5 Claims, 4 Drawing Sheets

HINGE FOR COLLAPSIBLE LADDERS

BACKGROUND OF THE INVENTION

The present invention relates to a hinge for collapsible ladders, and more particularly, to a hinge for collapsible ladders having an improved structure in which a hinge spring for the collapsible ladders is not exposed externally.

Korean Utility Model Registration No. 1991-303 discloses a common hinge for collapsible ladders. As shown in FIGS. 1A and 1B, this conventional invention discloses the hinge having an auxiliary round plate 3" disposed between a pair of round plates 3 and 3'. A rotary plate 11 contacts one side of the auxiliary round plate 3" by a flange 11' formed around the auxiliary round plate 3" and can be rotated. Center apertures, 4, 4' and 4" which mate with a center aperture 4"' of the rotary plate 11 are locked with a bushing 5, and a gap formed between portions A and B positioned in one direction of the flange 11' is used with an operating part 13 of the rotary plate 11. One end of a tension spring 14 is mounted in an aperture 13' of the operating part 13. Locking rods 8 and 8' of a locking handle 7 extend into apertures 15 and 16 and locking apertures 9 and 9' by pressure from a press part 18 having a press axle 6 with a spring 17 surrounding press axle 6. At the same time, the operating part 13 which is rotatably biased in the direction of portion A, provides that the locking rods 8 and 8' smoothly enter along inclined planes 16' of the apertures 16.

Since an operation of the hinge for the collapsible ladders disclosed in the above Korean Utility Model Registration has been already known, and also its structure does not include a characterized portion of the present invention, a detailed description thereof shall be omitted.

The hinge for the collapsible ladders described above has problems that may cause damage or breakdown of the spring due to its external exposure, and further, hands or gloves of an operator may be jammed in the spring when the press part is pressed.

SUMMARY OF THE INVENTION

In order to solve the above problems, it is an object of the present invention to provide a hinge for collapsible ladders having a safety structure which can inwardly house a hinge spring for the collapsible ladders, prevent any damage or breakdown of the spring, and keep an operator safe during use of the ladder.

To accomplish the above object of the present invention, a hinge for collapsible ladders, includes an external frame including a center aperture and a pair of locking apertures; an inner frame including a center aperture and a plurality of pairs of locking apertures, the inner frame being rotatably movable relative to the external frame around the center apertures; a rotary plate rotatably disposed between the inner frame and the external frame and having locking apertures therein; a substantially flat rotary spring having one end mounted to the inner frame and an opposite end mounted to the rotary plate to impart a turning force to the rotary plate; a hub member rotatably connecting the inner frame and the external frame about the center apertures, and supporting the frames, the hub member including a locking end at one side thereof; a locking part having a locking end for extension into the locking apertures of the external and inner frames to fix an angle of the inner frame and the external frame relative to each other; a press axle connected with the locking part and passing through the hub member, the press axle including a spring bearing end; and a spring positioned between the locking end of the hub member and the bearing end of the press axle.

DETAILED DESCRIPTION OF THE PREFERRED EMBODIMENT

A preferred embodiment of the present invention will be described below in more detail with reference to the accompanying drawings.

Figure 1A:
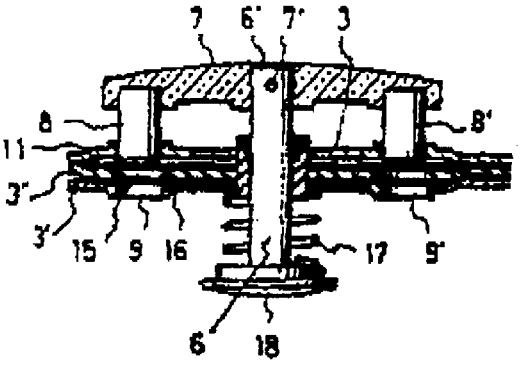
Fig. 1a PRIOR ART
FIG. 1*a* is a front view showing a conventional hinge for collapsible ladders.
Figure 1B:
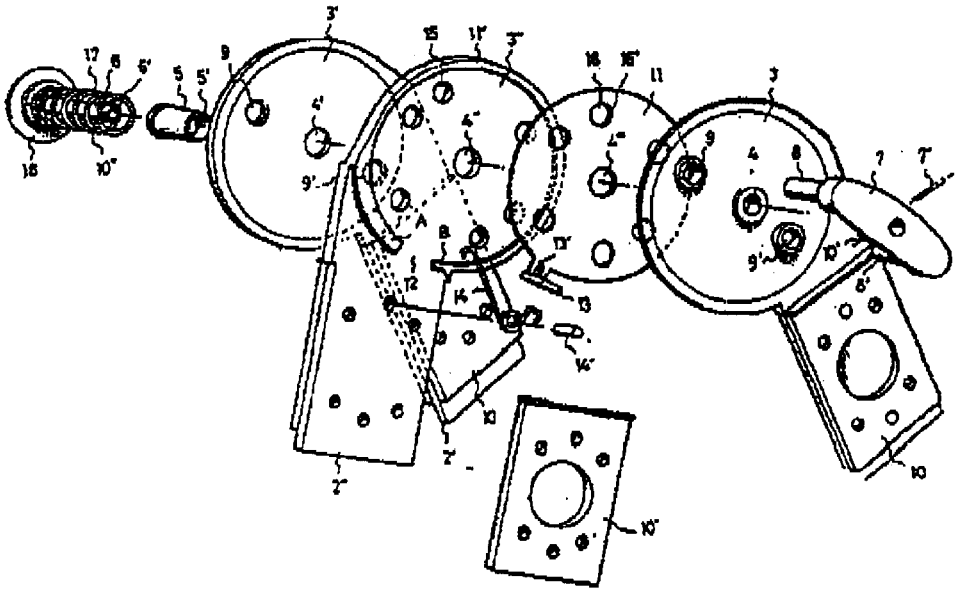
Fig. 1b PRIOR ART
FIG. 1*b* is an exploded perspective view showing the conventional hinge for collapsible ladders.
Figure 2:
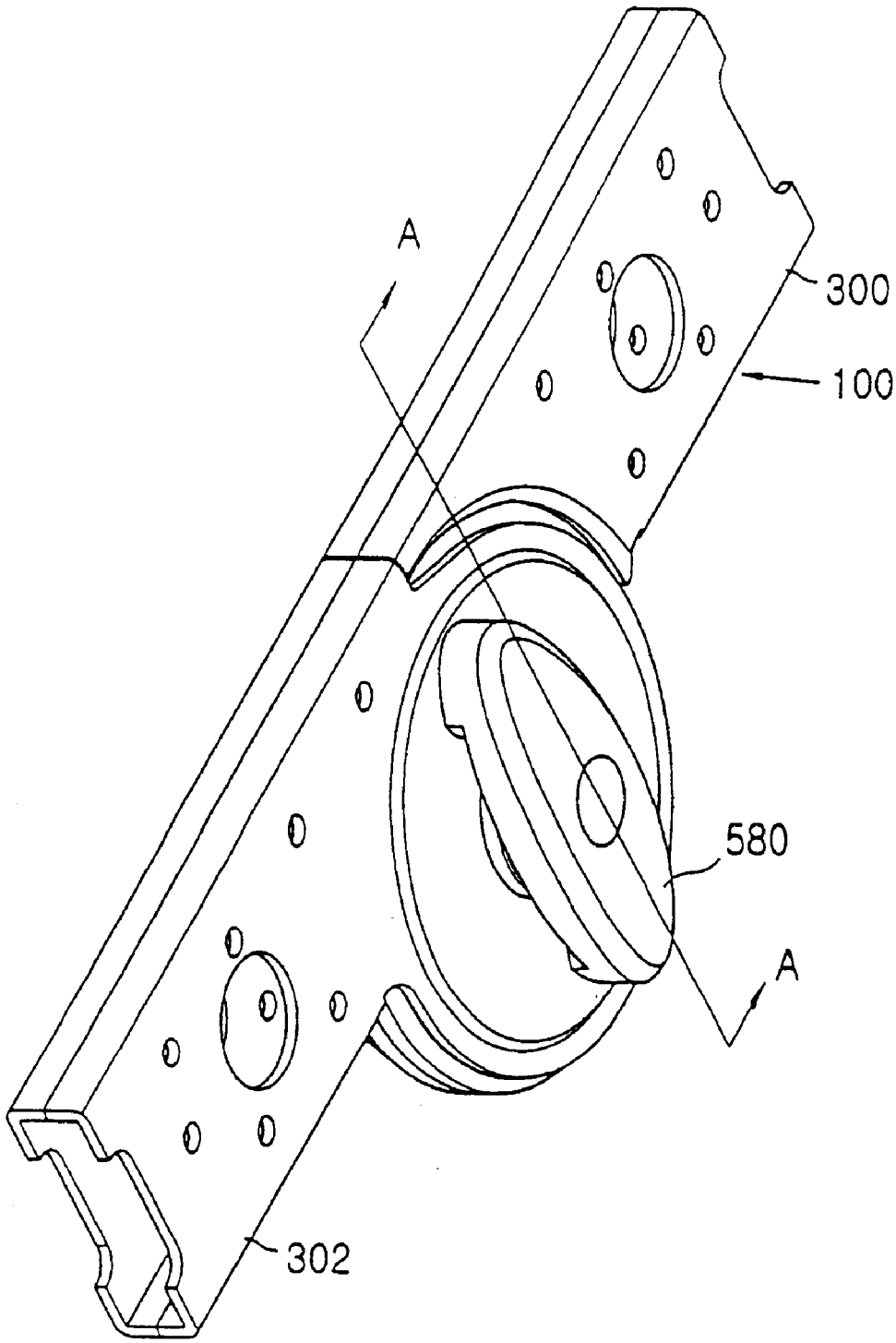
FIG. 2 is a perspective view showing a hinge for collapsible ladders according to the present invention.
Figure 3:
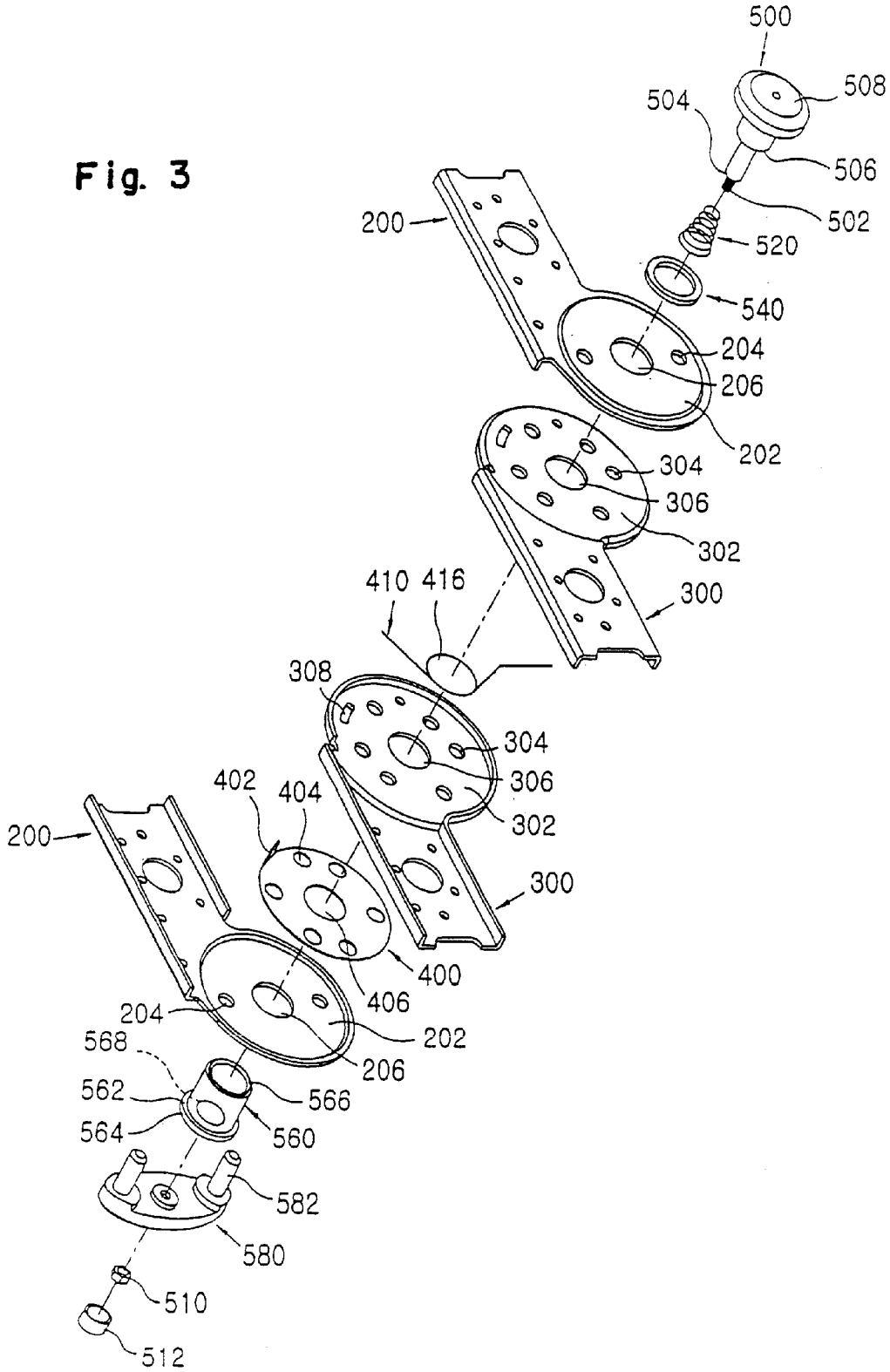
FIG. 3 is an exploded perspective view showing the hinge for collapsible ladders according to the present invention.

FIGS. 2 and 3 are a perspective view and an exploded perspective view showing the hinge for collapsible ladders according to the present invention.

As illustrated, an external frame 200 comprises 2 center aperture 206 for locking formed at the center thereof, and a pair of locking apertures 204 positioned in the periphery of the center aperture 206. An inner frame 300 which is connected into the inside of the external frame 200, comprises a center aperture 306 for locking formed at the center thereof, and pairs of locking apertures 304 positioned in the periphery of the center aperture 306, for adjusting a connection angle. Inner frame 300, as shown beet in FIG. 3 includes, two opposing circular disks 302 in spaced apart relation to form a hollow area therein, and opposing stringers extending therefrom. Aligned openings 308 are provided in circular disks 302. A rotary round plate 400 is disposed to rotatably move between the external frame 200 and the inner frame 300. The rotary round plate 400 comprises locking apertures 404 at the same position as those of the locking apertures 304 of the inner frame 300. In order to impart a turning force to the rotary round plate 400, one side of a substantially flat rotary spring 410 is locked to the inner frame 300, and the other side thereof is fitted with a bent part 402 of the rotary round plate 400 that extends through openings 308 in circular disks 302. The external and inner frames 200 and 300 and the rotary round plate 400 are rotatably assembled together in a center relation by an annular hub member 550. One side of the annular hub member 560 forms a locking end 564 and the other side thereof forms an unlocking end 566. It is preferable that the locking end 564 includes a frame bearing flange, and a side end of the unlocking end 566 is locked with a locking ring 540 by riveting.

A spring 520 is inserted between a press axle 500 and the locking end 564 of the annular hub member 560. The press axle 500 is locked with a nut 510 by extending a screw part 502 of the press axle 500 into a locking handle 580 through the annular hub member 560. Since the press axle 500 has a locking portion, it is tightly locked with the locking handle 580 with only the nut 510. After locking the press axle 500 and the locking handle 580 with the nut 510, it is preferable to fit a protection cap 512 over screw part 502 and nut 510 in order to prevent loosening of the nut 510.

Also, it is preferable that the spring 520 has a cone shape to guide the press axle 500.

Figure 4:
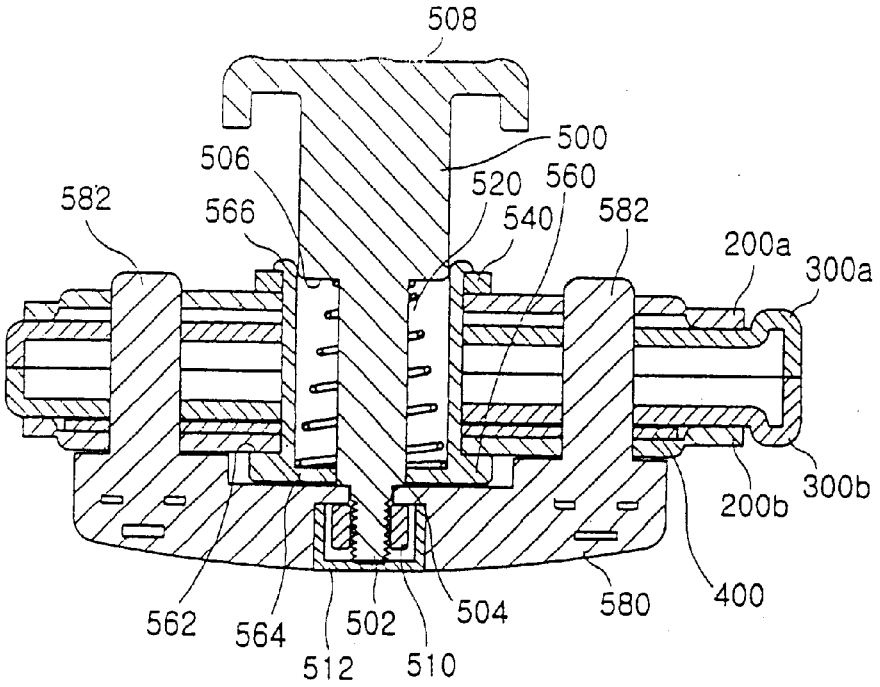
FIG. 4 is a sectional view of the hinge for collapsible ladders according to the present invention.

FIG. 4 is a sectional view taken along the line 4—4 of FIG. 2.

As shown, the annular hub member 560 has one locking end and another unlocking end. At the center of the locking end, there are provided a press axle aperture 568 through which the press axle 500 is passed, and a flange 562 for supporting the external frame 200. The annular hub member 560 passes through the center apertures of the locked frames, and is locked by riveting through a joint with the locking ring 540.

The press axle 500 comprises a screw part 502 positioned at the end thereof for connection with the locking handle 580, a locking pin 504 for supporting the locking handle 580, and a spring bearing end 506 for bearing the spring 520. As illustrated, one side of the spring 520 is supported by the spring bearing end 506, and the other side thereof is supported by the locking end 564 of the annular hub member 560.

The spring 520 is not exposed externally because it is housed between the locking end of the annular hub member 560 and the spring bearing end 506 of the press axle 500.

Figure 5:
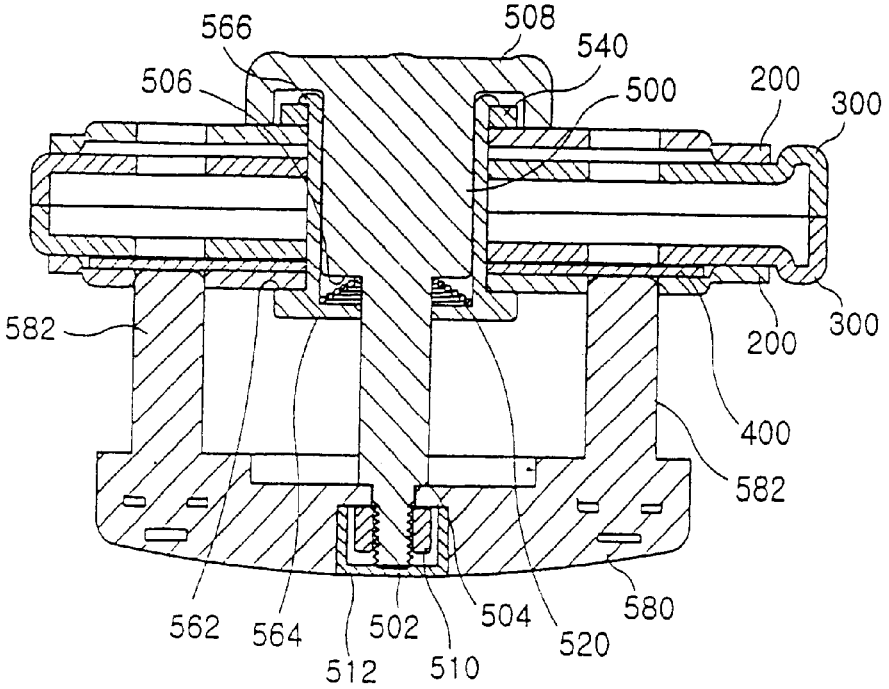
FIG. 5 is a sectional view illustrating an operation state of the hinge for collapsible ladders according to the present invention.

FIG. 5 is a sectional view showing a state where the press part 508 is pressed in to vary the connection angle of the frames.

As shown, even though the press part 508 is pressed, the spring is still disposed between the locking end 564 of the annular hub member 560 and the spring bearing end 506 of the press axle 500 to thereby avoid its exposure.

As described above, the hinge for the collapsible ladders having a safety structure according to the present invention can provide effects that prevent breakdown and damage of the spring and keep an operator safe during use of the ladder since the spring is housed within the annular hub member.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A hinge for collapsible ladders, comprising:

an external frame including a center aperture and a pair of locking apertures;

an inner frame including:

a center aperture, the inner frame being rotatably movable relative to the external frame around the center apertures, a plurality of pairs of locking apertures, and an opening;

a rotary plate rotatably disposed between the inner frame and the external frame and having locking apertures therein, the rotary plate having a tab that extends through the opening in the inner frame;

a substantially flat rotary spring having one end mounted to the inner frame and an opposite end mounted to the rotary plate to impart a turning force to the rotary plate;

a hub member rotatably connecting the inner frame and the external frame about the center apertures, and supporting the frames, the hub member including a locking end at one side thereof;

a locking part having a locking end for extension into the locking apertures of the external and inner frames to fix an angle of the inner frame and the external frame relative to each other;

a press axle connected with the locking part and passing through the hub member, the press axle including a spring bearing end;

a coil spring positioned within said hub between the locking end of the hub member and the bearing end of the press axle; and said substantially flat rotary spring mounted within the inner frame and having a first end locked to the inner frame and a second, opposite end engaging the tab of the rotary plate in order to impart a turning force to the rotary plate.

2. A hinge for collapsible ladders according to claim 1, further comprising a locking ring for engaging with an opposite side of the hub member to secure said frames together when the frames are mounted on the hub member.

3. A hinge for collapsible ladder according to claim 1, wherein the coil spring has a conical shape.

4. A hinge for collapsible ladders according to claim 1, wherein said coil spring is positioned within said hub at all times.

5. A hinge for collapsible ladders according to claim 1, wherein the coil spring moves the press axle outwardly away from the external frame when the locking part extends into the locking apertures of the external and inner frames to fix the angle of the inner frame and external frame relative to each other and is adapted to be compressed when said press axle is moved inwardly toward the external frame to remove the locking part from the locking apertures.

* * * * *